US008160481B2

(12) United States Patent
Kitagawa et al.

(10) Patent No.: US 8,160,481 B2
(45) Date of Patent: Apr. 17, 2012

(54) STORAGE CONTAINER, SUPPLY DEVICE, AND IMAGE FORMING APPARATUS

(75) Inventors: Hiroaki Kitagawa, Kanagawa (JP); Kei Hirata, Kanagawa (JP); Kouji Fukumuro, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 413 days.

(21) Appl. No.: 12/557,109

(22) Filed: Sep. 10, 2009

(65) Prior Publication Data

US 2010/0232840 A1 Sep. 16, 2010

(30) Foreign Application Priority Data

Feb. 23, 2009 (JP) ..... P2009-038900

(51) Int. Cl.
*G03G 15/08* (2006.01)

(52) U.S. Cl. ..... 399/258; 399/262

(58) Field of Classification Search ..... 399/107, 399/108, 111, 119, 120, 252, 258–263; 222/DIG. 1
See application file for complete search history.

(56) References Cited

U.S. PATENT DOCUMENTS

| | | | | |
|---|---|---|---|---|
| 7,062,205 | B2 * | 6/2006 | Nagashiro | 399/258 |
| 7,792,469 | B2 * | 9/2010 | Ichikawa et al. | 399/262 |
| 7,809,313 | B2 * | 10/2010 | Kitaoka | 399/258 |
| 7,826,779 | B2 * | 11/2010 | Mase et al. | 399/262 |

FOREIGN PATENT DOCUMENTS

JP 2005-134452 5/2005

* cited by examiner

*Primary Examiner* — Hoan Tran
(74) *Attorney, Agent, or Firm* — Morgan, Lewis & Bockius LLP

(57) ABSTRACT

A storage container includes a container body that stores a supplementary material and is detachably attached to an image forming apparatus; a discharge port that is provided at a bottom of the container body; two protrusions that protrude from the container body toward both sides; and an opening-closing member that is movably supported by a guide frame surrounding the discharge port, wherein a rearward movement of the opening-closing member is restricted by stoppers while the container body is mounted on the mounting unit, the protrusions come in contact with the stoppers and push the stoppers laterally to release the restriction of the opening-closing member while the container body is pulled out of the image forming apparatus, and a width, in an attaching/detaching direction of the container body, of one protrusion of the protrusions is smaller than that of the other protrusion.

10 Claims, 12 Drawing Sheets

STORAGE CONTAINER, SUPPLY DEVICE, AND IMAGE FORMING APPARATUS

CROSS-REFERENCE TO RELATED APPLICATIONS

This application is based on and claims priority under 35 USC 119 from Japanese Patent Application No. 2009-038900 filed on Feb. 23, 2009.

BACKGROUND

1. Technical Field

The present invention relates to a storage container, a supply device, and an image forming apparatus.

2. Related Art

In an image forming apparatus that forms a visible image by transferring a toner onto an electrostatic latent image formed on an image holding member, the toner stored in a developing device is consumed as an image is formed. There is a widely known image forming apparatus that is provided with a toner storage container for supplying a toner in accordance with the consumption of the toner. The toner storage container may be detachably attached to the image forming apparatus, and the toner stored in the toner storage container may be supplied to the developing device while the toner storage container is mounted on the image forming apparatus. Further, after the toner stored in the toner storage container is supplied to the developing device, the toner storage container is detached from the image forming apparatus and may be replaced with a new toner storage container.

SUMMARY

According to an aspect of the invention, there is provided a storage container including: a container body that stores a powdery or liquid supplementary material to be supplied to an image forming apparatus, and is detachably attached to the image forming apparatus by being put in or pulled out of the image forming apparatus in a predetermined direction; a discharge port that is provided at a bottom of the container body and used to discharge the supplementary material; two protrusions that protrude from the container body toward both sides; and an opening-closing member that is movably supported by a guide frame surrounding the discharge port, and opens or closes the discharge port as the container body is moved in a direction where the container body is detachably attached to the image forming apparatus, wherein a rearward movement of the opening-closing member is restricted by stoppers that are provided at a mounting unit and pushed toward the middle from both sides of the container body, while the container body is mounted on the mounting unit provided at the image forming apparatus and the discharge port is opened, the protrusions come in contact with the stoppers and push the stoppers laterally to release the restriction of the opening-closing member while the container body is pulled out of the image forming apparatus, and a width, in an attaching/detaching direction of the container body, of one protrusion of the protrusions is smaller than that of the other protrusion that protrudes toward the opposite side of the container body.

BRIEF DESCRIPTION OF THE DRAWINGS

Exemplary embodiments of the present invention will be described in detail based on the following figures, wherein.

DETAILED DESCRIPTION

Exemplary embodiments of the invention will be described below with reference to drawings.

Figure 1:
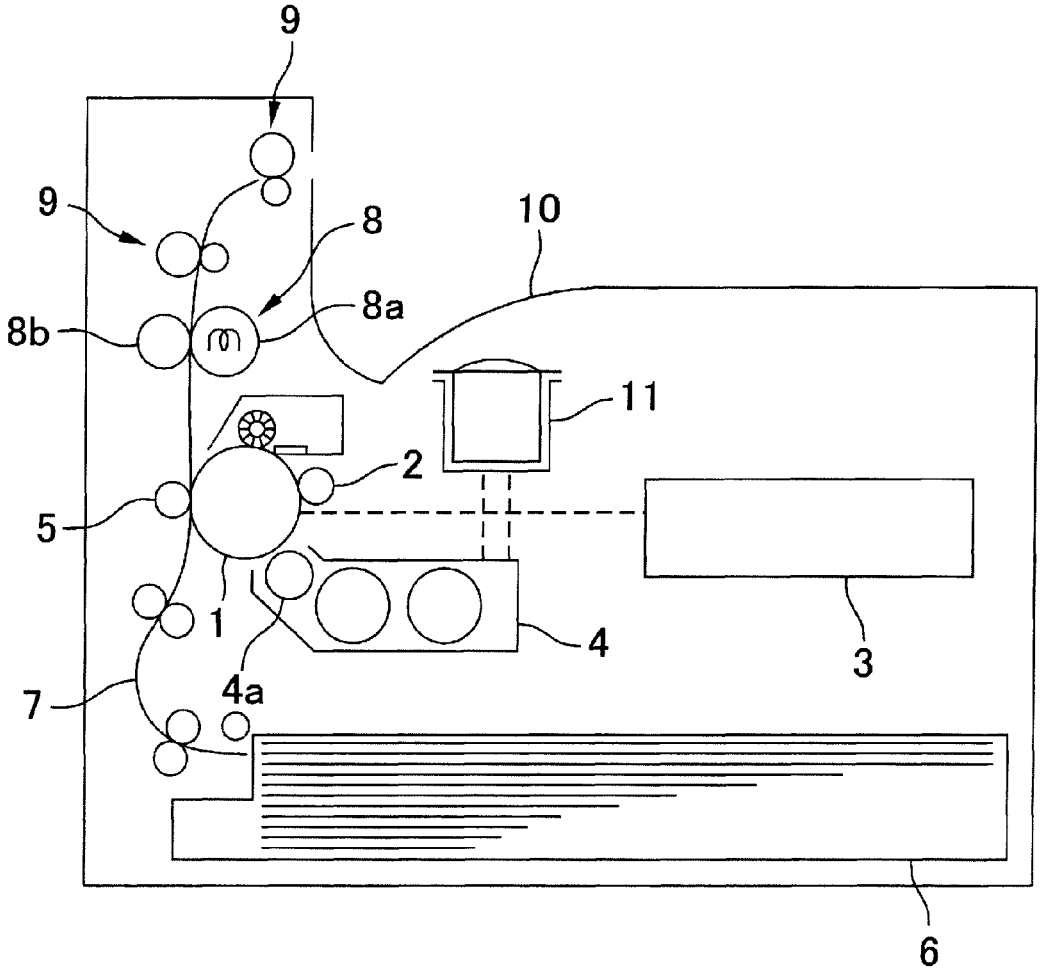
FIG. 1 is a schematic view showing the configuration of an image forming apparatus according to an exemplary embodiment of the invention.

FIG. 1 is a schematic view showing the configuration of an image forming apparatus according to an exemplary embodiment of the invention.

The image forming apparatus includes a cylindrical image holding member, that is, a photoreceptor drum 1. An electrostatic latent image is formed on the surface of the image holding member. Further, the image forming apparatus includes a charging device 2 that substantially uniformly charges the surface of the photoreceptor drum with electricity, an exposure device 3 that writes an electrostatic latent image on the uniformly charged photoreceptor drum 1 by exposing the uniformly charged photoreceptor drum with the image light based on image signals, a developing device 4 that forms a toner image by attaching a toner to the electrostatic latent image, and a transfer roller 5 that transfers the toner image formed on the photoreceptor drum onto a recording sheet. A recording sheet is fed between the transfer roller 5 and the photoreceptor drum 1 via a transporting path 7 from a sheet tray 6 that is a sheet supply device.

A fixing device 8, which heats and presses the toner image to attach the toner image to the recording sheet, is provided downstream of the transfer roller 5 in a transporting direction of the recording sheet. Feed rollers 9 for transporting a recording sheet and a sheet output tray 10 are provided downstream of the fixing device. Accordingly, the recording sheet to which the toner image is fixed is fed to the sheet output tray 10.

Further, a toner supply device 11, which supplies a toner to the developing device 4, is provided above the developing device, and a toner storage container disposed in the toner supply device is detachably attached to the toner supply device.

The photoreceptor drum 1 is formed by forming an organic photoreceptor layer on the peripheral surface of a cylindrical member that is made of metal. The metal portion of the photoreceptor drum is electrically grounded.

The charging device 2 includes a roller-like member that is formed by coating a cylindrical metal core, which is made of stainless steel, with rubber having medium resistance. The charging device charges the surface of the photoreceptor drum 1 at a desired voltage by applying a voltage, where an AC component is superimposed on a DC component, to the photoreceptor drum.

The exposure device 3 generates a laser beam that flickers on the basis of the image signal, and scans the photoreceptor drum with the laser beam in the main scanning direction of the photoreceptor drum 1 by using a polygon mirror. Accordingly, the potential of a portion of the photoreceptor drum 1, which is irradiated with the laser beam, is reduced, and a latent image formed by the difference in the electrostatic potential is formed on the surface of the photoreceptor drum 1.

A two-component developer, which includes a toner and a magnetic carrier, is used as a developer in the developing device 4. While being magnetically attracted to a developing roller 4*a* that is disposed close to the photoreceptor drum 1 and faces the photoreceptor drum, the two-component developer is carried. Further, the two-component developer forms a layer, which has an appropriate thickness, on the developing roller 4*a* by a regulation blade, and is supplied to a position facing the photoreceptor drum 1. A developing bias voltage is applied to the developing roller 4*a* so that the toner is transferred onto the electrostatic latent image formed on the photoreceptor drum.

Meanwhile, the developing device may use a monocomponent developer instead of the two-component developer.

The transfer roller 5 is provided at a position facing the photoreceptor drum 1. The transfer roller 5 is formed in the shape of a roller by forming an outer peripheral portion, which is made of a conductive rubber material, on a metal core.

The fixing device 8 includes a heating roller 8*a* in which a source of heat is built, and a pressure roller 8*b* that is disposed to come in contact with the heating roller 8*a*. Further, a recording sheet is fed between the heating roller 8*a* and the pressure roller 8*b* and heated and pressed so that the toner image is fixed onto the recording sheet.

An elastic layer formed of an elastic material such as a heat resistant rubber is formed on the peripheral surface of a metal core of the heating roller 8*a*, and a surface release layer is formed on the elastic layer. A halogen heater is built in the heating roller as a source of heat.

The pressure roller 8*b* is formed by coating the metal core with a surface release layer.

Figure 2:
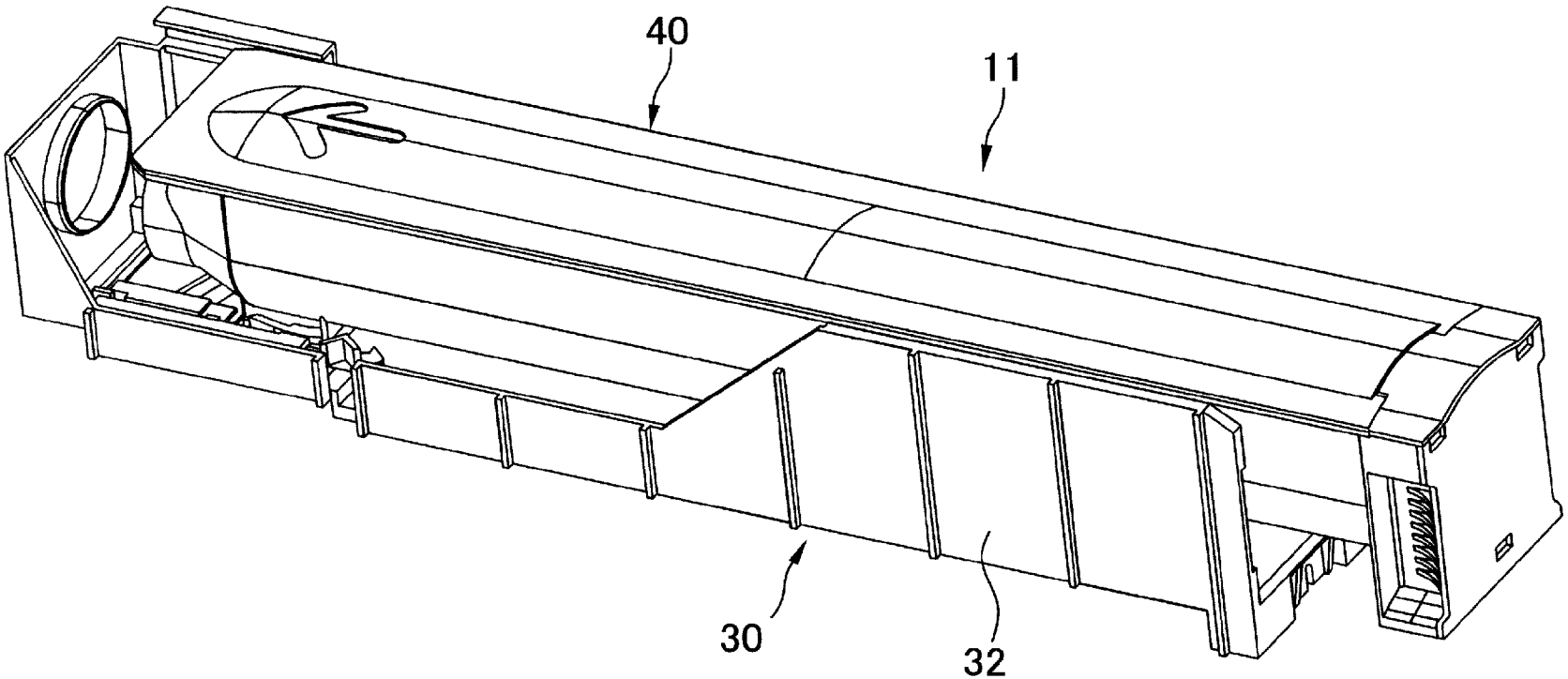
FIG. 2 is a schematic perspective view of a toner supply device that is used for the image forming apparatus shown in FIG. 1.

As shown in FIG. 2, the toner supply device 11 includes a mounting unit 30 that is supported by an image forming apparatus body, and a toner storage container 40 that is detachably attached to the mounting unit 30. The toner storage container 40 is mounted at a predetermined position in the mounting unit 30, so that the developing device 4 may be supplied with a toner.

Figure 3:
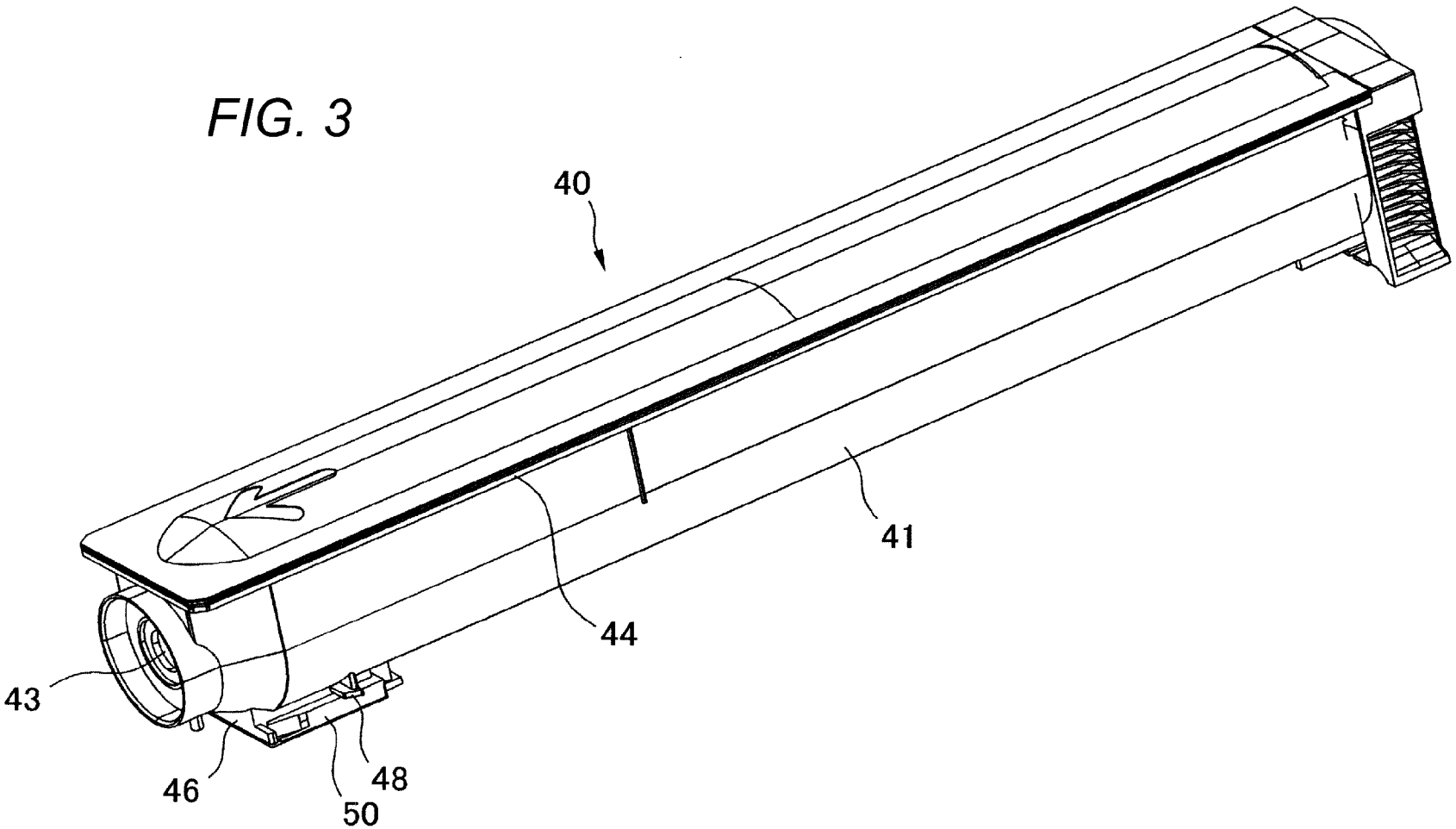
FIG. 3 is a schematic perspective view of a toner storage container that is used for the toner supply device shown in FIG. 2.
Figure 4:
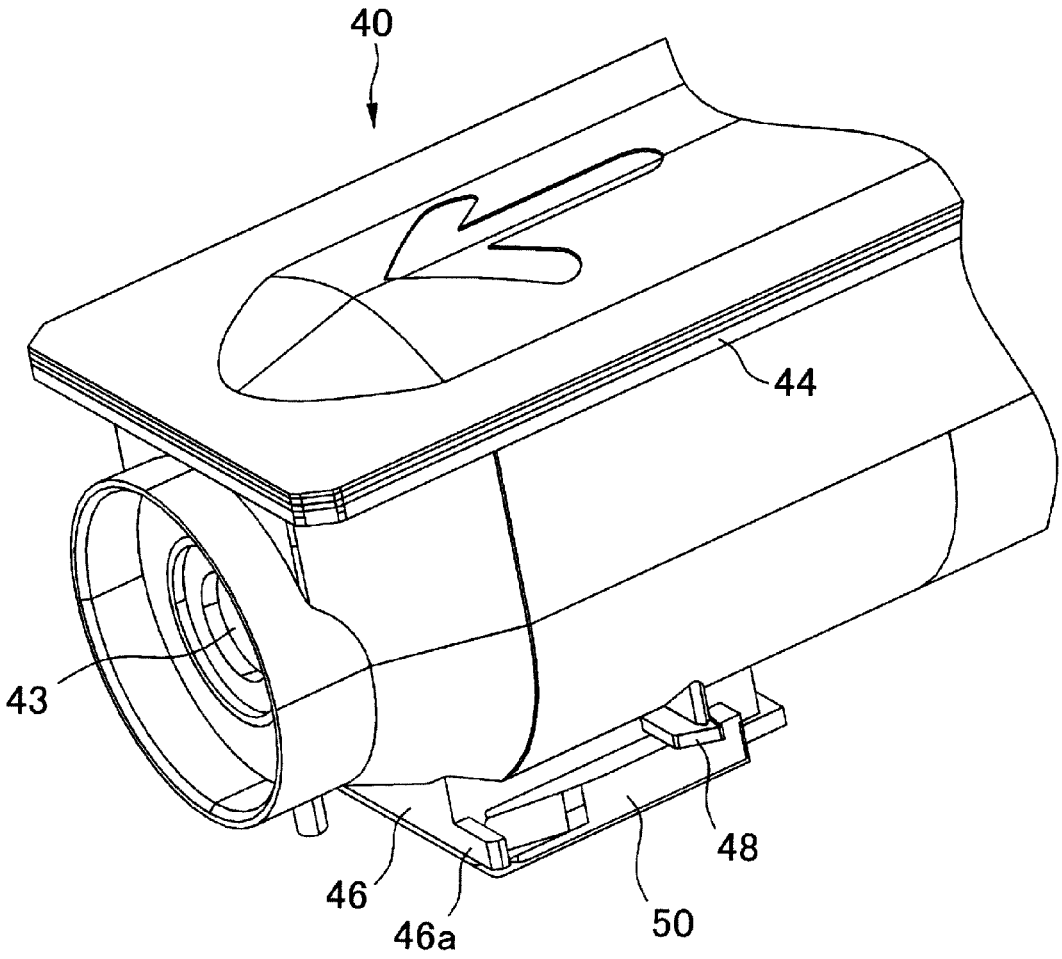
FIG. 4 is an enlarged view of a front portion of the toner storage container in a mounting direction where the toner storage container shown in FIG. 3 is mounted on the mounting unit.
Figure 5:
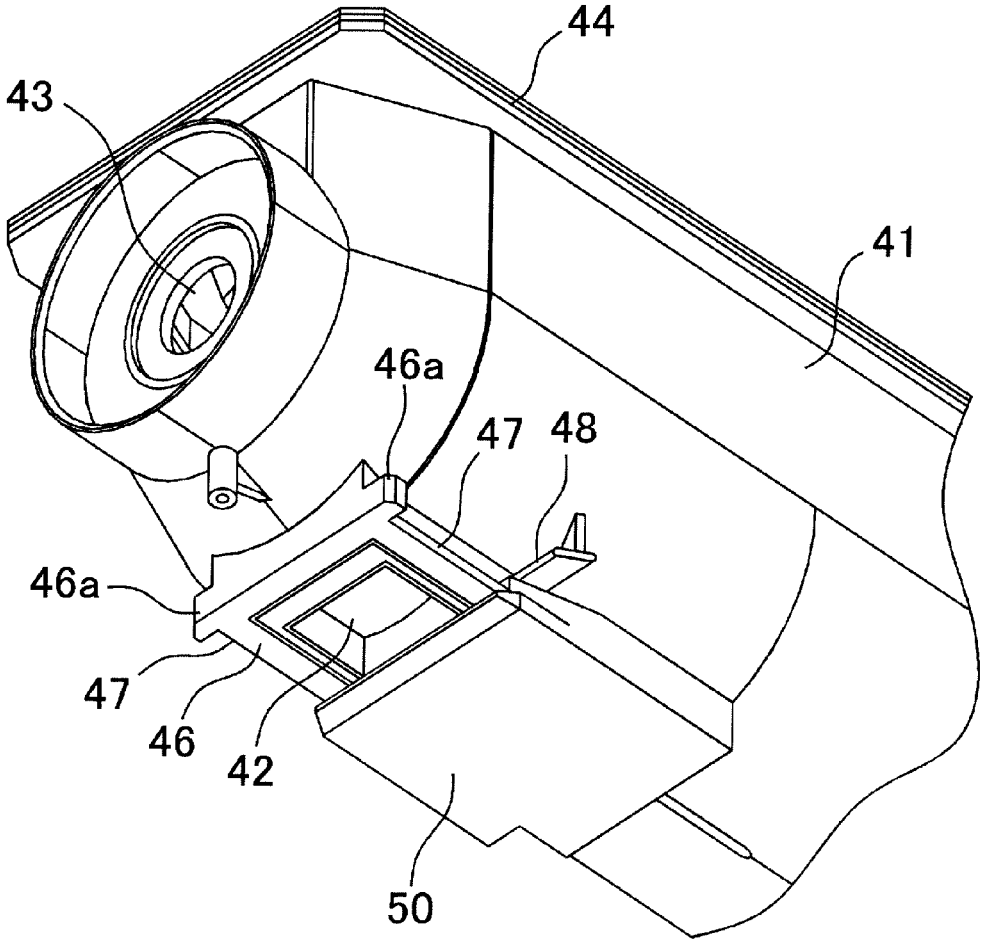
FIG. 5 is a schematic perspective view of the front portion of the toner storage container shown in FIG. 3 as seen from the lower side.
Figure 6:
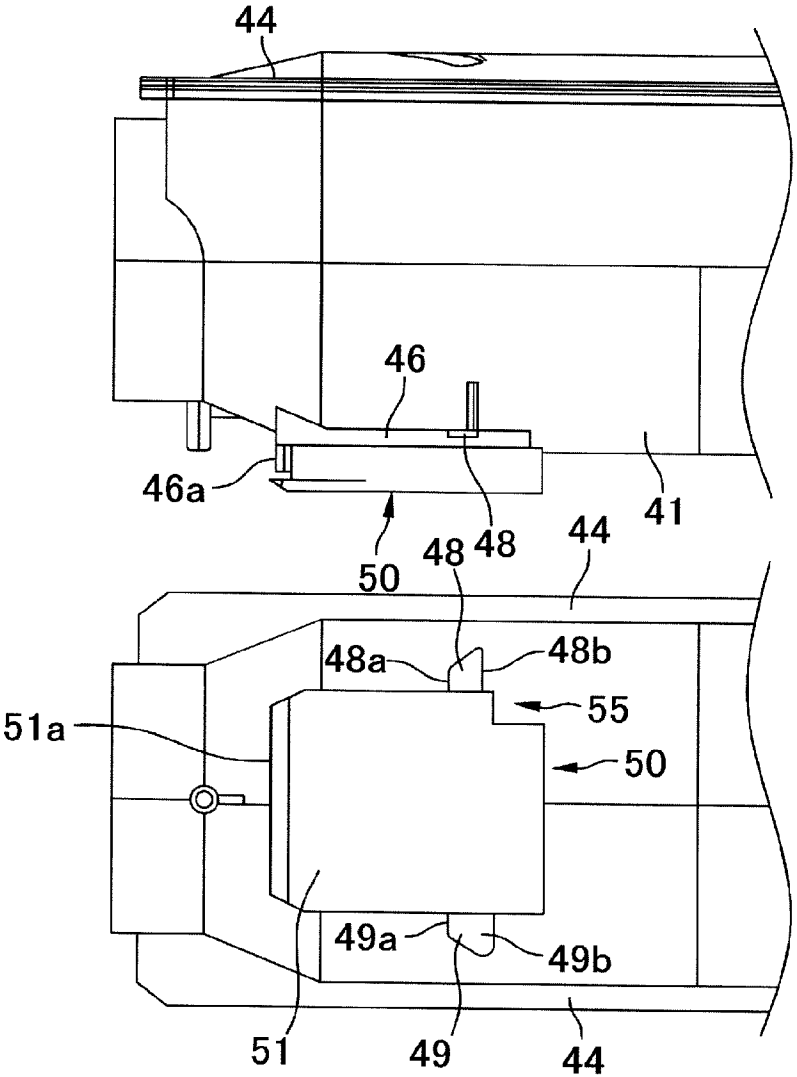
FIG. 6 shows a schematic front view, a schematic side view, and a schematic bottom view of the front portion of the toner storage container shown in FIG. 3.
Figure 6:
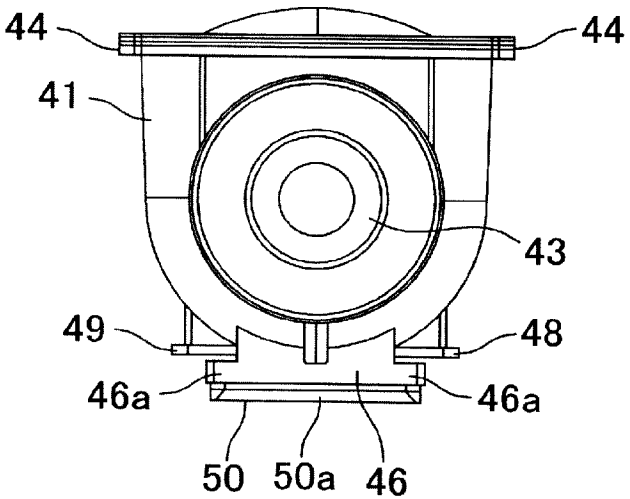

FIG. 3 is a schematic perspective view of the toner storage container, and FIG. 4 is an enlarged view of a front portion of the toner storage container in amounting direction where the toner storage container is mounted on the mounting unit. Further, FIG. 5 is a schematic perspective view of the front portion of the toner storage container as seen from the lower side, and FIG. 6 shows a schematic front view, a schematic side view, and a schematic bottom view of the front portion of the toner storage container.

As shown in FIG. 3, the toner storage container 40 mainly includes a container body 41, a shutter 50 that is an opening-closing member for opening and closing a toner discharge port 42 formed at the bottom of the container body 41, and a stirring-conveying member (not shown) that stirs the toner in the container body and conveys the toner toward the toner discharge port 42.

The container body 41 is a hollow cylindrical member of which both ends are closed, and a toner is stored in the container body. The end of the container body in the mounting direction forms a connection section 43 that transmits drive torque to the stirring-conveying member. When the toner storage container is completely mounted, drive torque is transmitted to the stirring-conveying member and the toner is released to be conveyed. Further, a slide plate 44, which protrudes outward toward both ends of the container body, is formed at the upper portion of the container body 41. The slide plate comes in contact with the upper portions of the side walls of the mounting unit 30, and the container body 41 may be put in and pulled out along the side walls.

The toner discharge port 42 through which the stored toner is discharged, and a guide frame 46 that supports the shutter 50 provided at the toner discharge port 42 are provided at the front portion of the bottom of the container body 41.

As shown in FIG. 5, the toner discharge port 42 has a rectangular shape. However, as long as the stored toner can fall, the toner discharge port may have any shape.

The guide frame 46 is formed to surround the toner discharge port 42. Protruding portions 47, which protrude outward and are continuous in the mounting direction, are provided at frames that are provided at both ends of the toner discharge port 42 with respect to the mounting direction of the container body 41. The shutter 50 is supported so as to hold the protruding portions 47 and can slide along the protruding portions 47 in the mounting direction of the container body 41.

Further, first and second protrusions 48 and 49, which protrude toward both sides, are formed on both side surfaces of a portion where the guide frame 46 and the container body 41 are joined to each other. The protrusions are formed so that the length of each of the protrusions is gradually decreased toward the front side from the rear side in the mounting direction. In addition, as shown in FIG. 6, the length of the first protrusion 48 in the attaching/detaching direction of the toner storage container 40 is smaller than that of the second protrusion 49 in the mounting direction, the positions of front ends 48*a* and 49*a* of the protrusions are set to be the same positions in the attaching/detaching direction, and a rear end 48*b* of the first protrusion 48 is positioned ahead of a rear end 49*b* of the second protrusion 49. When the toner storage container 40 is pulled out of the mounting unit 30, these protrusions 48 and 49 release the restriction of the position of the shutter 50 that is performed by stoppers to be described blow.

The functions of the first and second protrusions 48 and 49 will be described below.

As shown in FIGS. 5 and 6, the shutter 50 is supported so as to hold the protruding portions 47 provided at the guide frame 46. Accordingly, the shutter is moved along the protruding portions 47, and opens and closes the toner discharge port 42 formed at the container body 41.

Figure 7:
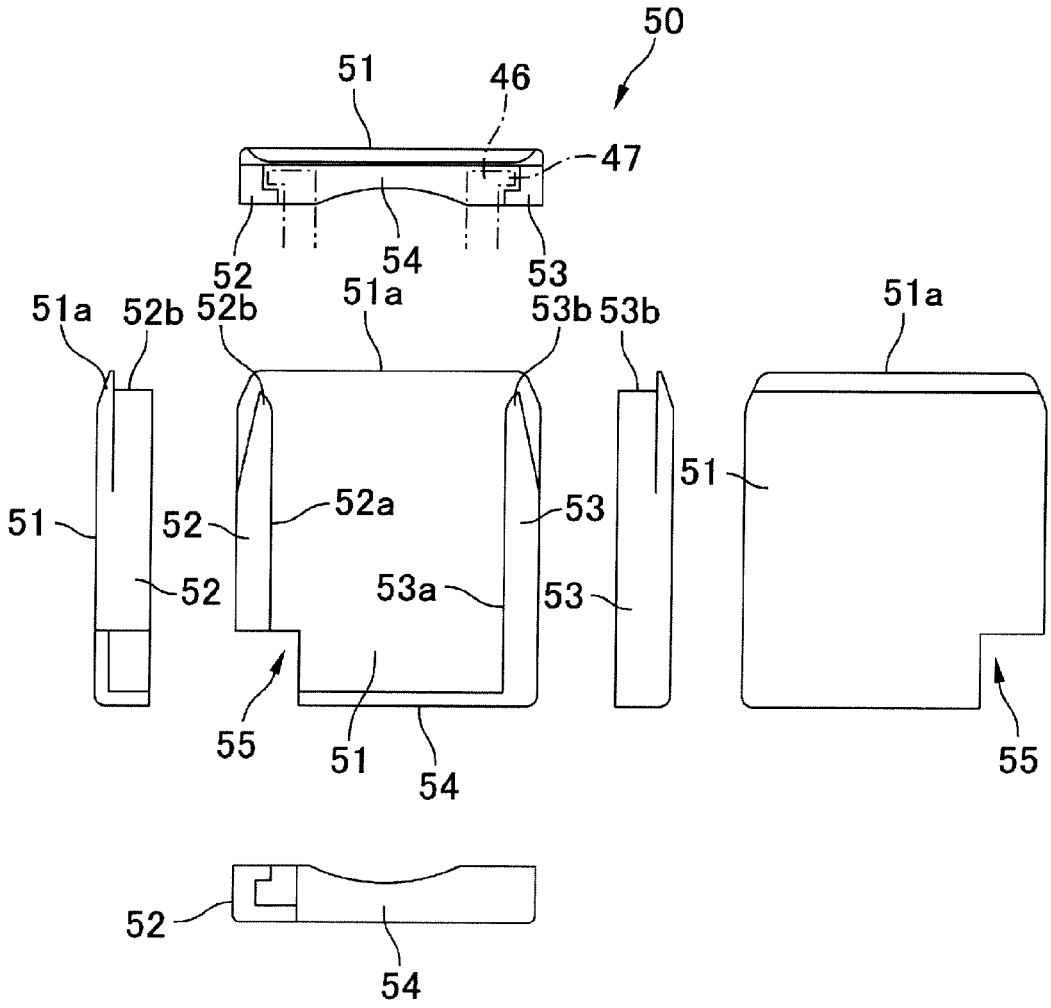
FIG. 7 is a set of 6 drawings of a shutter that is mounted on the toner storage container shown in FIG. 3.

As shown in a set of 6 drawings that is FIG. 7, the shutter 50 includes a cover 51 that closes the toner discharge port 42, side walls 52 and 53 are connected to both side portions of the cover 51 and are erected toward the container body, and a rear wall 54 is erected on the rear side. Further, the ends 52*a* and 53*a* of the side walls protrude inward, are fitted to the protruding portions so as to hole the protruding portions 47 of the guide frame 46, and may slide along the protruding portions 47 in the attaching/detaching direction of the toner storage container 40.

The rear wall 54 is formed to bump against the rear end of the guide frame 46 at a position where the shutter 50 completely closes the toner discharge port 42, and the slide of the cover in an inserting direction is limited from the position where the rear wall bumps against the rear end of the guide frame. Further, when reaching the position where the shutter 50 closes the toner discharge port 42, the ends 52*a* and 53*a* of the side walls 52 and 53 bump against a front bump portion 46*a* formed at the guide frame 46, so that the forward movement is restricted.

Meanwhile, a rectangular notch 55 is formed at a rear portion of the shutter 50 that corresponds to the first protrusion 48. The function of the notch 55 will be described below.

Figure 8:
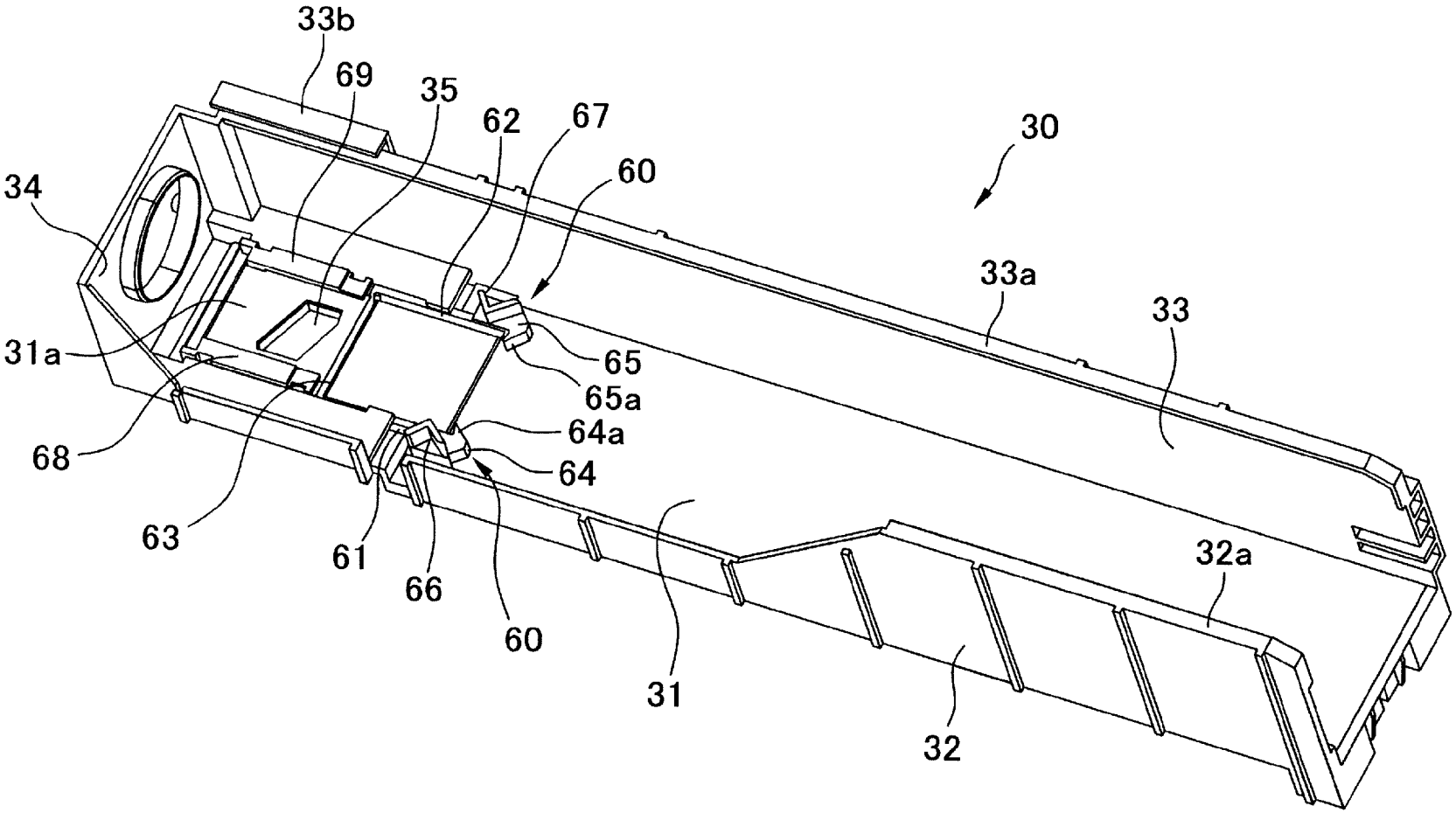
FIG. 8 is a schematic perspective view of the mounting unit on which the toner storage container shown in FIG. 3 is mounted.
Figure 9:
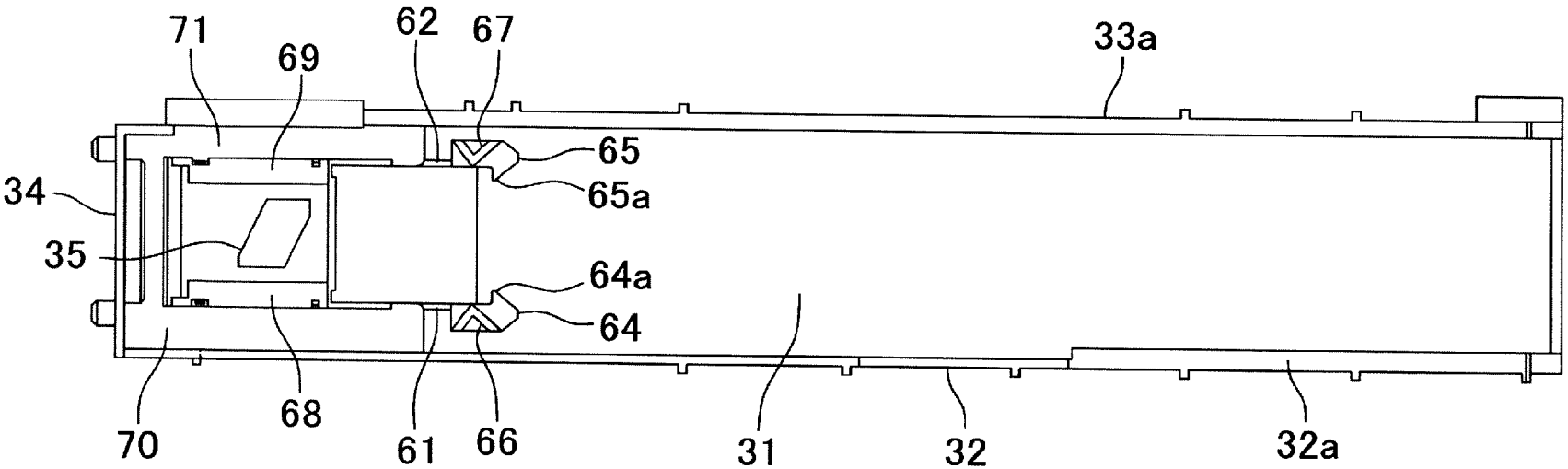
FIG. 9 is a schematic plan view of the mounting unit on which the toner storage container shown in FIG. 2 is mounted.

FIG. 8 is a schematic perspective view of the mounting unit 30, and FIG. 9 is a plan view of the mounting unit.

In the mounting unit 30, a bottom plate 31, side plates 32 and 33, and a front plate 34 are integrally formed with each other. The bottom plate 31 is provided so as to face the bottom of the toner storage container 40. The side plates 32 and 33 are provided on both sides with respect to the mounting direction of the toner storage container 40. The front plate 34 supports the front portion of the toner storage container 40. Accordingly, the toner storage container 40 is supported at a predetermined position, and the developing device 4 may be supplied with a toner.

As shown in FIG. 8, a toner supply port 35 and the stoppers 60 are provided at the bottom plate 31. The toner discharged from the toner storage container 40 is input to the toner supply port 35 and supplied to the developing device 4. When the toner storage container 40 is mounted so that the toner may be discharged, the stoppers 60 limit the movement of the shutter 50.

When the toner storage container 40 is mounted on the mounting unit 30 at a predetermined position, the toner supply port 35 is positioned at a position facing the toner discharge port 42. Further, the developing device 4 is supplied with the toner input to the toner supply port 35 via a toner conveying path (not shown).

In this exemplary embodiment, the toner supply port 35 is formed in the shape of an askew rectangular opening, that is, in a shape close to a parallelogram. However, as long as a supplementary toner can be input from the toner storage container 40, the toner supply port may be formed in any shape and be positioned at any position.

A pair of stoppers 60 is provided on both sides of a mounting position of the toner storage container 40. The stoppers mainly include two rod-like members 61 and 62 that are disposed parallel to each other on the bottom plate in the mounting direction of the toner storage container 40, first and second rear restricting portions 64 and 65 that are connected to the rear ends of the rod-like members 61 and 62, respectively, and first and second wall-like portions 66 and 67 that are erected on the upper surfaces of the rear restricting portions 64 and 65, respectively. Further, the front ends of the rod-like members 61 and 62 are connected to each other in a width direction by a front restricting member 63. Further, the rod-like members 61 and 62 and the front restricting member 63 are connected to and are integrally formed with first and second regulation plates 68 and 69 that come in contact with the guide frame 46 and regulate the position of the container body 41 in the mounting unit 30.

Each of the rod-like members 61 and 62 is made of an elastically deformable material, for example, a synthetic resin. If an external force is applied to increase the gap between the rear portions of the two rod-like members 61 and 62 disposed parallel to each other, the rod-like members 61 and 62 are elastically bent outward. Accordingly, if an external force for widening the gap is applied to the rear restricting portions 64 and 65 and the wall-like portions 66 and 67 that are integrally formed with the rod-like members 61 and 62, the rear restricting portions 64 and 65 and the wall-like portions 66 and 67 are deformed outward. If the external force is removed, the rear restricting portions 64 and 65 and the wall-like portions 66 and 67 return to the original positions.

The front restricting member 63 connects the rod-like members 61 and 62 in the width direction. Further, when the container body 41 is inserted into the mounting unit 30, an end 51*a* of the shutter 50 bumps against the front restricting member, so that the further forward insertion of the shutter 50 is regulated.

As shown in FIGS. 8 and 9, the rear restricting portions 64 and 65 are connected to the rear ends of the rod-like members 61 and 62, and include hook-shaped portions 64*a* and 65*a* that are formed to protrude toward the centerline of the container body 41 in a direction where the container body 41 is mounted. Further, the hook-shaped portions 64*a* and 65*a* are provided at the same position in the mounting direction of the container body 41 so as to face each other.

The wall-like portions 66 and 67 are formed on the first and second rear restricting portions 64 and 65, respectively, and face each other. The opposite surfaces of the wall-like portions have a planar shape where the opposite surfaces are spaced from each other from the middle portion toward the front and rear sides. That is, the standing surfaces facing each other have a planar shape which is convex toward the inside.

The regulation plates 68 and 69 protrude toward the middle on the front side of the front restricting portion 63 so as to have a space between themselves and the bottom plate 31*a* in the vicinity of the toner supply port. Further, the protruding portions 47 of the guide frame 46 are interposed between the regulation plates 68 and 69 and the bottom plate 31*a*, so that the upward and downward movement of the container body 41 is restricted.

Meanwhile, the front ends of the regulation plates 68 and 69 are connected to each other and fixedly supported by a front end of the mounting unit 30.

The side plates 32 and 33 are integrally formed with the bottom plate 31 on both sides with respect to the mounting direction. The second plate 33 is formed over the entire length in the attaching/detaching direction, and the height of the second plate 33 is slightly larger than that of the toner storage container 40. An upper portion 33*a* of the side plate 33 is formed evenly and the slide plate 44 of the toner storage container 40 is laid on the upper portion of the side plate, so that the downward movement of the toner storage container 40 is regulated. Therefore, the attachment and detachment of the toner storage container to the mounting unit 30 is guided.

Further, a guide 33*b* for guiding the slide plate 44 of the toner storage container 40 is formed at the front portion of the second side plate 33, and the upward movement of the toner storage container 40 is also regulated in this area. Accordingly, while the downward movement of the slide plate 44 of the toner storage container 40, which is to be inserted along the second sideplate 33, is regulated, the toner storage container begins to be inserted. As the toner storage container continues to be inserted, the upward and downward movement of the toner storage container is regulated.

Meanwhile, a portion, of which the height is slightly larger than the height of the toner storage container 40, is formed only at the rear portion of the first side plate 32 in the mounting direction, and the height of the front portion of the first side plate 32 is smaller than that of the toner storage container 40. In an area of which the height is slightly larger than that of the toner storage container 40, that is, an area of which the height is substantially equal to that of the second side plate 33, an upper portion 32*a* of the first side plate 32 is formed evenly like in the second sideplate 33. Accordingly, the downward movement of the slide plate 44 of the toner storage container 40 may be regulated in this area.

The operation for attaching/detaching the toner storage container to/from the mounting unit will be described with reference to FIGS. 10 to 13. In FIGS. 10 to 13, for convenience of description, the mounting unit 30 and the shutter 50 supported by the toner storage container 40 are shown by a solid line, and an outline of the container body, a part of the bottom plate, and protrusions 48 and 49 are shown by a dashed-dotted line.

Figure 10:
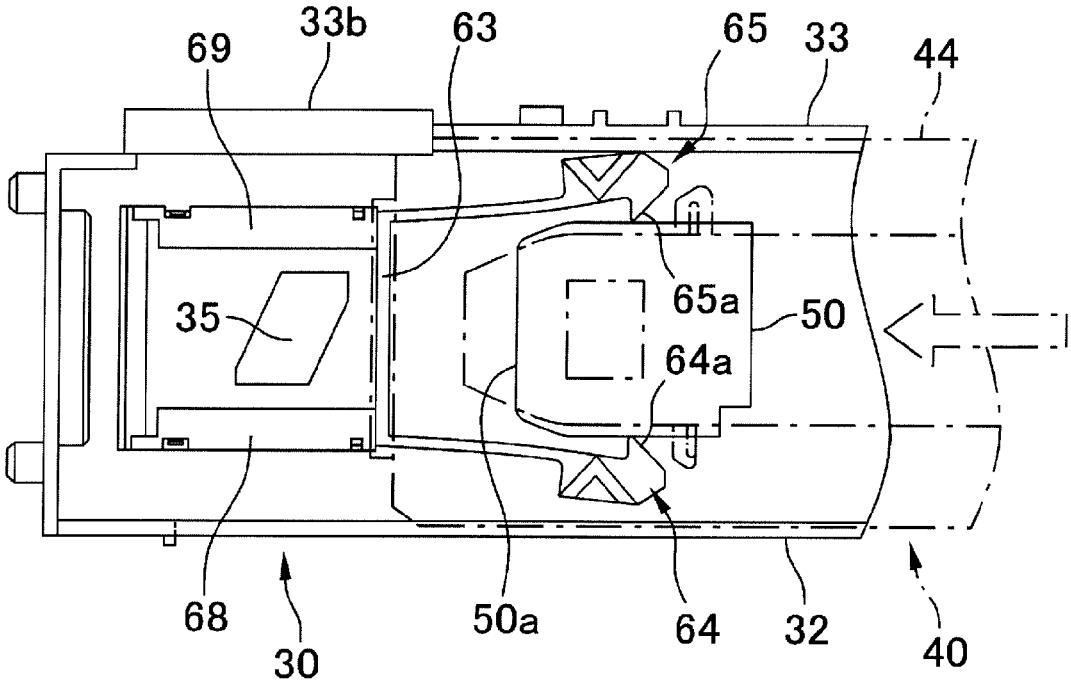
FIG. 10 is a schematic plan view illustrating an operation that attaches/detaches the toner storage container to/from the mounting unit.

FIG. 10 is a schematic plan view showing that the toner storage container 40 is inserted into the mounting unit 30, and shows that the toner storage container is inserted into the mounting unit while the both side surfaces of the shutter 50 widen the space between the hook-shaped portions 64*a* and 65*a* provided at the rear restricting portions 64 and 65.

As shown in the drawings, the slide plate 44 provided at the upper portion of the container body 41 is inserted while being supported by the first sideplate 32 of the mounting unit 30 and the upper portion of the second side plate 33. When the shutter 50 reaches the position of the rear restricting portions 64 and 65, both side walls 52 and 53 of the shutter 50 advance while pushing the first and second rear restricting portions 64 and 65 to the outside, which are supported so as to elastically recede, to the outside. Further, the forward movement of the shutter 50 is restricted at the position where the end 51*a* of the shutter 50 bumps against the front restricting member 63 formed at the mounting unit 30. A force, which is applied to the rear restricting portions 64 and 65 by the shutter 50, is cancelled at this time, and the rear restricting portions 64 and 65 return to the original positions, that is, the positions where the shutter 50 does not come in contact with the rear restricting portions. Accordingly, the first and second rear restricting portions 64 and 65 restrict the rear portion of the shutter 50, so that the rearward movement of the shutter 50 is also regulated.

Figure 11:
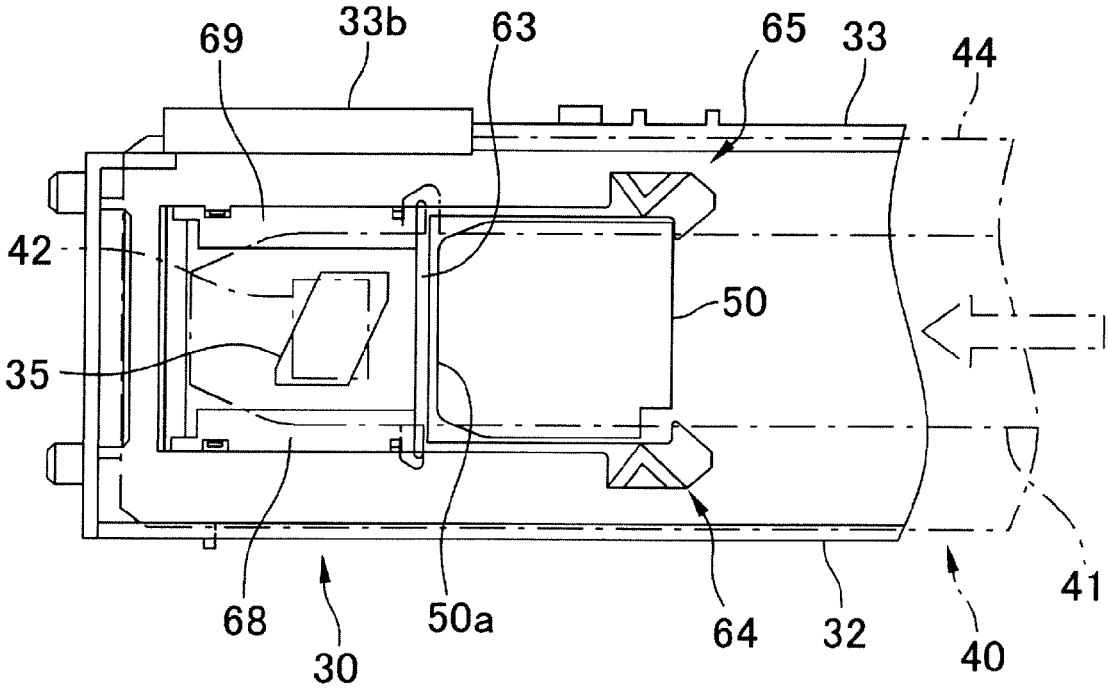
FIG. 11 is a schematic plan view illustrating the operation that attaches/detaches the toner storage container to/from the mounting unit.

If the container body 41 is further inserted after the forward movement of the shutter 50 is restricted, the slide plate 44 formed at the side portion of the toner storage container 40 comes in contact with the guide 33*b* formed at the second side wall 33 of the mounting unit 30. Accordingly, the upward and downward movement of the toner storage container is regulated and the toner storage container is guided forward. Further, while the upward and downward movement of the protruding portions 47 formed at both sides of the guide frame 46 is also regulated by the first and second regulation plates 68 and 69 that are formed at the mounting unit 30, the protruding portions are guided by the first and second regulation plates. Furthermore, when the container body 41 is mounted at a predetermined mounting position as shown in FIG. 11, the opened toner discharge port 42 faces the toner supply port 35 that is formed at the mounting unit 30. Accordingly, the developing device 4 is supplied with the toner discharged from the toner discharge port 42 through the toner supply port 35.

Figure 12:
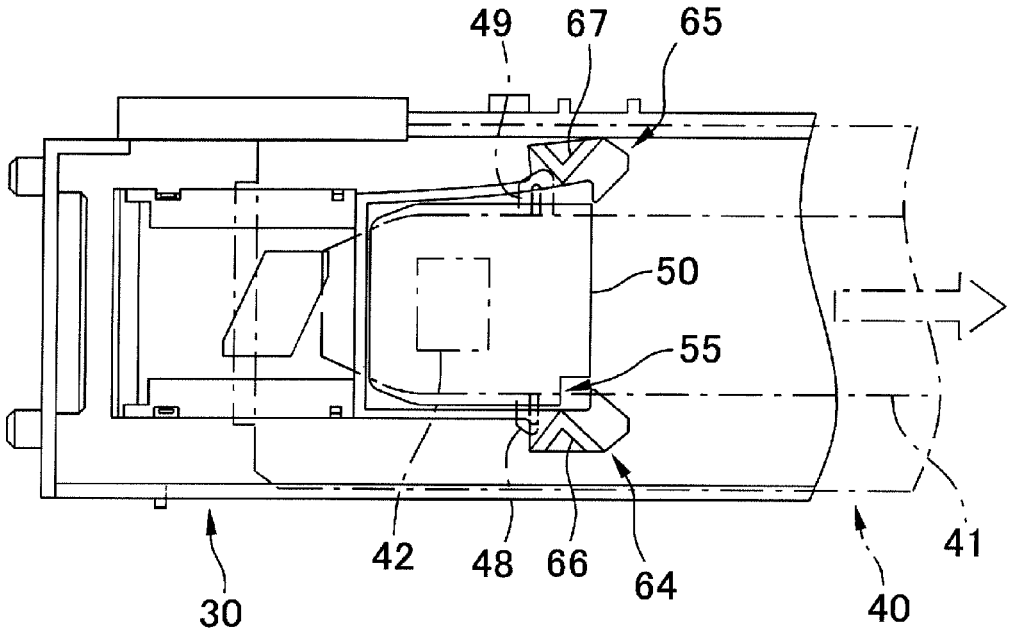
FIG. 12 is a schematic plan view illustrating the operation that attaches/detaches the toner storage container to/from the mounting unit.

When the developing device is completely supplied with the toner stored in the toner storage container 40, the toner storage container 40 is pulled out of the mounting unit 30 and replaced with a new toner storage container. FIG. 12 is a schematic plan view showing that the toner storage container is pulled out of the mounting unit in order to replace the toner storage container.

If the container body 41 begins to recede when the movement of the shutter 50 is restricted by the rear restricting portions 64 and 65 as shown in FIG. 11, the shutter 50 is moved relative to the container body 41 to the front side where the toner discharge port 42 is formed and the toner discharge port 42 is gradually closed. Further, when the toner storage container 40 recedes to the position where the shutter 50 completely closes the toner discharge port 42, the second protrusion 49, which protrudes laterally from the container body 41, bumps against the second wall-like portion 67 as shown in FIG. 12 and is moved along the surface of the second wall-like portion 67 while pushing the second wall-like portion 67 to the outside. Accordingly, the second rear restricting portion 65 is moved laterally, so that the restriction of the rear portion of the shutter 50 performed by the second rear restricting portion 65 is released.

Meanwhile, since the rear end of the first protrusion 48 is positioned ahead of the second protrusion 49, the first protrusion 48 comes in contact with the first wall-like portion 66 after the second protrusion 49 comes in contact with the second wall-like portion 67. Further, while the first wall-like portion 66 is pushed to the outside, the restriction of the rear portion of the shutter 50 that is performed by the first rear restricting portion 64 is released, so that the shutter 50 may recede.

Meanwhile, the shutter 50 begins to recede after the second protrusion 49 releases the restriction of the second rear restricting portion 65. At this time, the first rear restricting portion 64, which begins to recede behind the second rear restricting portion 65, does not recede to the position where the restriction of the shutter 50 is completely released. However, since the notch 55 is formed at the rear end of the shutter 50, there is no trouble in making the toner storage container 40 recede.

Figure 13:
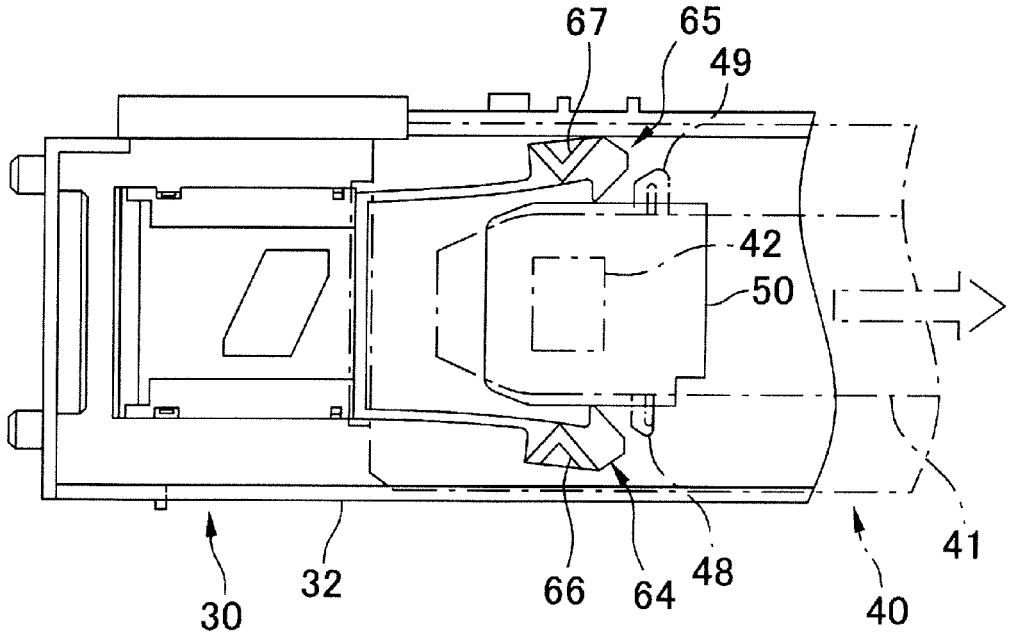
FIG. 13 is a schematic plan view illustrating the operation that attaches/detaches the toner storage container to/from the mounting unit.

FIG. 13 is a schematic plan view showing that the stoppers release the restriction of the shutter 50.

If the rear portion of the shutter 50 is released from the rear restricting portions 64 and 65 as shown in FIG. 13, the shutter 50 may recede. Accordingly, the shutter 50 closing the toner discharge port 42 may be pulled out of the mounting unit 30 together with the container body 41.

Due to this operation, when the toner storage container 40 is pulled out, a time difference is set between the time when the first protrusion 48 comes in contact with the wall-like portion 66 and the time when the second protrusion 49 comes in contact with the wall-like portion 67. Accordingly, when the toner storage container is pulled out, resistance is reduced.

Further, in this exemplary embodiment, a guide is not provided at the front upper portion of the first side plate 32 of the mounting unit 30, and the upward and downward movement of the slide plate 44 of the toner storage container 40, which is inserted along the first side plate 32, is not regulated even when the toner storage container 40 is inserted up to the vicinity of the front portion of the mounting unit 30. For this reason, the vertical position of the toner storage container 40 is not fixed at a position along the first side plate 32, and the toner storage container may be inserted in an unstable state. Accordingly, the first protrusion 48 may ride on the first wall-like portion 66 during the mounting of the toner storage container. However, the length of the first protrusion 48 in the mounting direction is set to be small. Accordingly, the first protrusion 48 may get over the first wall-like portion 66, the toner discharge port 42 may be opened at a predetermined position, and the toner storage container may be smoothly mounted at a predetermined position.

A second exemplary embodiment of the invention will be described below with reference to FIG. 14.

In an image forming apparatus according to this exemplary embodiment, like in the first exemplary embodiment, a toner storage container is detachably attached to a mounting unit. However, the second exemplary embodiment is different from the first exemplary embodiment in terms of the shape of a first protrusion formed at the toner storage container, the shape of a rear portion of a shutter, and the position of a first rear restricting portion formed at the mounting unit. Since other structures of the second exemplary embodiment are the same as those of the first exemplary embodiment, the description thereof will be omitted and other structures will be denoted by the same reference numerals.

Figure 14:
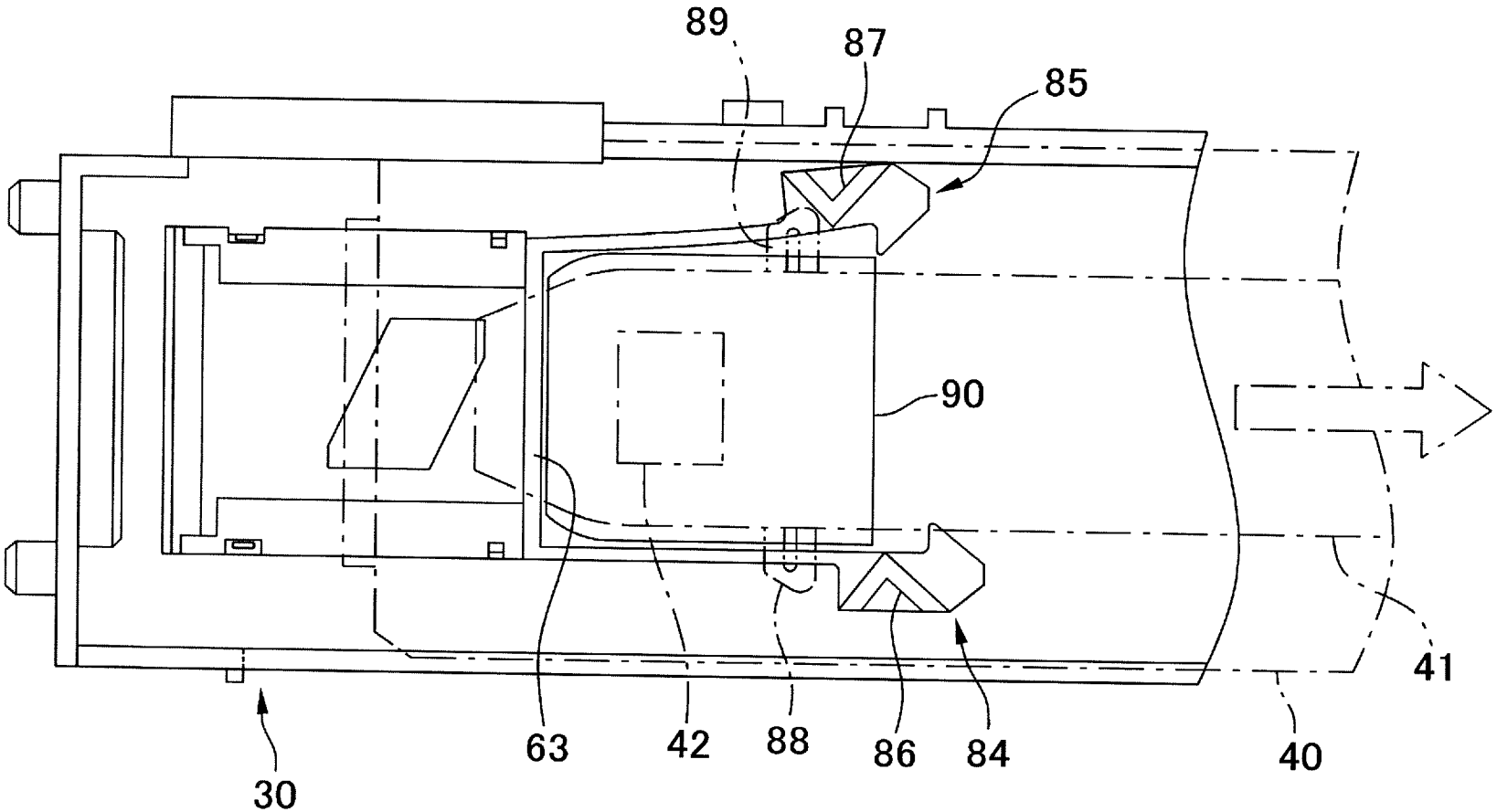
FIG. 14 is a schematic plan view of a toner storage container of an image forming apparatus according to a second exemplary embodiment of the invention and a mounting unit for the toner storage container, Wherein 1 denotes PHOTORECEPTOR DRUM, 2 denotes CHARGING DEVICE, 3 denotes EXPOSURE DEVICE, 4 denotes DEVELOPING DEVICE, 5 denotes TRANSFER ROLLER, 6 denotes SHEET TRAY, 7 denotes TRANSPORTING PATH, 8 denotes FIXING DEVICE, 9 denotes FEED ROLLER, 10 denotes SHEET OUTPUT TRAY, 11 denotes TONER SUPPLY DEVICE, 30 denotes MOUNTING UNIT, 31 denotes BOTTOM PLATE, 32 denotes FIRST SIDE PLATE, 32*a* denotes UPPER PORTION OF FIRST SIDE PLATE, 33 denotes SECOND SIDE PLATE, 33*a* denotes UPPER PORTION OF SECOND SIDE PLATE, 33*b* denotes GUIDE, 34 denotes FRONT PLATE, 35 denotes TONER SUPPLY PORT, 40 denotes TONER STORAGE CONTAINER, 41 denotes CONTAINER BODY, 42 denotes TONER DISCHARGE PORT, 43 denotes CONNECTION SECTION, 44 denotes SLIDE PLATE, 46 denotes GUIDE FRAME, 47 denotes PROTRUDING PORTION, 48 and 88 denote FIRST PROTRUSION, 49 and 89 denote SECOND PROTRUSION, 50 denotes SHUTTER, 51 denotes COVER, 52 and 53 denotes SIDE WALL, 54 denotes REAR WALL, 55 denotes NOTCH, 60 denotes STOPPER, 61 and 62 denote ROD-LIKE MEMBER, 63 denotes FRONT RESTRICTING MEMBER, 64 and 84 denotes FIRST REAR RESTRICTING PORTION, 64*a* denotes HOOK-SHAPED PORTION PROVIDED AT FIRST REAR RESTRICTING PORTION, 65 and 85 denote SECOND REAR RESTRICTING PORTION, 65*a* denotes HOOK-SHAPED PORTION PROVIDED AT SECOND REAR RESTRICTING PORTION, 66 and 86 denote FIRST WALL-LIKE PORTION, 67 and 87 denote SECOND WALL-LIKE PORTION, 68 denotes FIRST REGULATION PLATE, and 69 denotes SECOND REGULATION PLATE.

FIG. 14 is a schematic plan view showing that the toner storage container mounted on the mounting unit is pulled out of the mounting unit.

As shown in FIG. 14, first and second protrusions 88 and 89 provided at the toner storage container 40 are disposed at the same positions in the mounting direction of the toner storage container 40, and the length and shape of the first protrusion 88 are also the same as those of the second protrusion 89.

Further, a notch is not formed at a rear portion of a shutter 90 that corresponds to a first rear restricting portion 84.

Meanwhile, first and second rear restricting portions 84 and 85 of stoppers provided at the mounting unit 30 are disposed at different positions in the mounting direction of the toner storage container 40, and the first rear restricting portion 84 is provided behind the second rear restricting portion 85 in the mounting direction.

The attachment and detachment of the toner storage container to and from the mounting unit is performed as follows:

When the toner storage container 40 is inserted into the mounting unit 30, a front portion of the shutter 90 makes the first rear restricting portion 84 recede outward and then makes the second rear restricting portion 85 recede outward and the shutter advance. Further, when the shutter reaches a predetermined position, the end of the shutter 90 bumps against a front restricting member 63 provided at the mounting unit 30, so that the shutter 90 is stopped. After that, only a container body 41 continues to advance and is mounted on the mounting unit 30 at a predetermined position. At this time, the rearward movement of the shutter 90 is regulated by the rear restricting portion 85.

When the toner storage container 40 is pulled out, only the container body 41 recedes while the movement of the shutter 90 is regulated by the rear restricting portion 89 at an early stage after the toner storage container begins to be pulled out. Further, when the toner storage container recedes up to the position where a toner discharge port 42 is closed by the shutter 90, the second protrusion 89 bumps against a second wall-like portion 87 and makes the second rear restricting portion 85 recede outward. After that, the first protrusion 88 comes in contact with a first wall-like portion 86 and the first wall-like portion 86 is pushed to the outside. Accordingly, the restriction of the shutter 90 is released, and the toner storage container 40 is pulled out while the shutter 90 closes the toner discharge port 42.

Meanwhile, even in this exemplary embodiment, when the toner storage container 40 is pulled out, there is a time difference between the time when the first protrusion 88 comes in contact with the first rear restricting portion 84 and the time when the second protrusion 89 comes in contact with the second rear restricting portion 85. Accordingly, when the toner storage container is pulled out, resistance is reduced. Further, in this exemplary embodiment, the end of the shutter 90 comes in contact with the rear restricting portions 84 and 85 with a time difference even during the mounting of the toner storage container. Accordingly, resistance is reduced.

Furthermore, the first rear restricting portion 84 and the first wall-like portion 86 are disposed behind the second rear restricting portion 85 and the second wall-like portion 87. Accordingly, since the first protrusion 88 may ride on the first wall-like portion 86, a riding-on state is easily released. Therefore, it may be possible to avoid the difficulty in mounting the toner storage container that is caused by the deviation of the toner storage container from a previously supposed position during the mounting of the toner storage container 40. As a result, it may be possible to mount the toner storage container at a regular position.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A storage container comprising:

a container body that stores a powdery or liquid supplementary material to be supplied to an image forming apparatus, and is detachably attached to the image forming apparatus by being put in or pulled out of the image forming apparatus in a predetermined direction;

a discharge port that is provided at a bottom of the container body and used to discharge the supplementary material;

two protrusions that protrude from the container body toward both sides; and an opening-closing member that is movably supported by a guide frame surrounding the discharge port, and opens or closes the discharge port as the container body is moved in a direction where the container body is detachably attached to the image forming apparatus, wherein a rearward movement of the opening-closing member is restricted by stoppers that are provided at a mounting unit and pushed toward the middle from both sides of the container body, while the container body is mounted on the mounting unit provided at the image forming apparatus and the discharge port is opened, the protrusions come in contact with the stoppers and push the stoppers laterally to release the restriction of the opening-closing member while the container body is pulled out of the image forming apparatus, and a width, in an attaching/detaching direction of the container body, of one protrusion of the protrusions is smaller than that of the other protrusion that protrudes toward the opposite side of the container body.

2. The storage container according to claim 1, wherein positions of rear ends of the protrusions, which are provided on both sides of the container body, are different from each other in the mounting direction of the container body, and when the container body is pulled out of the image forming apparatus, the protrusions come in contact with the stoppers with a time difference and push the stoppers laterally.

3. A supply device comprising:

a storage container that stores a powdery or liquid supplementary material to be supplied to an image forming apparatus; and amounting unit where the storage container is attached or detached by being put in or pulled out in a predetermined direction, wherein the storage container comprises:

a discharge port that is provided at a bottom and is used to discharge the supplementary material, two protrusions that protrude from the storage container toward both sides, and an opening-closing member that is movably supported by a guide frame surrounding the discharge port and opens or closes the discharge port as the storage container is moved in a direction where the container body is detachably attached to the image forming apparatus, the mounting unit comprises stoppers that are provided on both sides of a position where the storage container is mounted, are pushed toward the middle of the container body, and restrict the rearward movement of the opening-closing member when the storage container is completely mounted on the mounting unit, the protrusions come in contact with the stoppers and push the stoppers laterally to release the restriction of the opening-closing member while the storage container is pulled out of the image forming apparatus, and a width, in an attaching/detaching direction of the container body, of one protrusion of the protrusions is smaller than that of the other protrusion that protrudes toward the opposite side of the container body.

4. The supply device according to claim 3, wherein the stoppers comprise:

rod-like elastic members that are disposed in the mounting direction on both sides of a position where the storage container is mounted on the mounting unit, respectively, and rear restricting portions that are connected to one ends of the elastic members, protrude toward the middle from the sides of the opening-closing member, and come in contact with the opening-closing member to restrict the rearward movement of the opening-closing member, deformation of the other ends of the elastic members is restricted, and wall-like portions coming in contact with the protrusions are provided on the upper surfaces of the rear restricting portions.

5. An image forming apparatus comprising:

an image holding member that has an endless peripheral surface on which an electrostatic latent image is formed;

a developing device that forms a visible image by developing a developer onto the electrostatic latent image formed on the image holding member;

a transfer device that transfers the visible image formed on the image holding member onto a recording sheet or an intermediate transfer body; and a supply device that supplies a developer to the developing device, wherein the supply device is the supply device according to claim 4.

6. An image forming apparatus comprising:

an image holding member that has an endless peripheral surface on which an electrostatic latent image is formed;

a developing device that forms a visible image by developing a developer onto the electrostatic latent image formed on the image holding member;

a transfer device that transfers the visible image formed on the image holding member onto a recording sheet or an intermediate transfer body; and a supply device that supplies a developer to the developing device, wherein the supply device is the supply device according to claim 3.

7. A supply device comprising:

a storage container that stores a powdery or liquid supplementary material to be supplied to an image forming apparatus; and a mounting unit where the storage container is attached or detached by being put in or pulled out in a predetermined direction, wherein the storage container comprises:

a discharge port that is provided at the bottom and is used to discharge the supplementary material, two protrusions that protrude from the storage container toward both sides, and an opening-closing member that is movably supported by a guide frame surrounding the discharge port, and opens or closes the discharge port as the storage container is moved in a direction where the container body is detachably attached to the image forming apparatus, the mounting unit comprises stoppers that are provided on both sides of a position where the storage container is mounted, are pushed toward the middle of the container body, and restrict the rearward movement of the opening-closing member when the storage container is completely mounted on the mounting unit, positions of the stoppers are different from each other in the mounting direction of the storage container, and after the storage container is pulled out of the image forming apparatus and the opening-closing member closes the discharge port, the protrusions come in contact with the stoppers with a time difference and push the stoppers laterally to release the restriction of the opening-closing member.

8. The supply device according to claim 7, wherein the stoppers comprise:

rod-like elastic members that are disposed in the mounting direction on both sides of a position where the storage container is mounted on the mounting unit, respectively, and rear restricting portions that are connected to one ends of the elastic members, protrude toward the middle from the sides of the opening-closing member, and come in contact with the opening-closing member to restrict the rearward movement of the opening-closing member, deformation of the other ends of the elastic members is restricted, and wall-like portions coming in contact with the protrusions are provided on the upper surfaces of the rear.

9. An image forming apparatus comprising:

an image holding member that has an endless peripheral surface on which an electrostatic latent image is formed;

a developing device that forms a visible image by developing a developer onto the electrostatic latent image formed on the image holding member;

a transfer device that transfers the visible image formed on the image holding member onto a recording sheet or an intermediate transfer body; and a supply device that supplies a developer to the developing device, wherein the supply device is the supply device according to claim 8.

10. An image forming apparatus comprising:

an image holding member that has an endless peripheral surface on which an electrostatic latent image is formed;

a developing device that forms a visible image by developing a developer onto the electrostatic latent image formed on the image holding member;

a transfer device that transfers the visible image formed on the image holding member onto a recording sheet or an intermediate transfer body; and a supply device that supplies a developer to the developing device, wherein the supply device is the supply device according to claim 7.

* * * * *